US005178526A

United States Patent [19]

Galante et al.

[11] Patent Number: 5,178,526

[45] Date of Patent: Jan. 12, 1993

[54] COUPLING MECHANISM FOR CO-ORBITING SCROLL MEMBERS

[75] Inventors: Christopher R. Galante, East Syracuse; James W. Bush, Skaneateles, both of N.Y.

[73] Assignee: Carrier Corporation, Syracuse, N.Y.

[21] Appl. No.: 808,821

[22] Filed: Dec. 17, 1991

[51] Int. Cl.[5] ..... F01C 1/04

[52] U.S. Cl. ..... 418/55.3; 418/55.4; 418/55.5; 418/57

[58] Field of Search ..... 418/55.3, 55.5, 57

[56] References Cited

U.S. PATENT DOCUMENTS

| | | | |
|---|---|---|---|
| 801,182 | 10/1905 | Creux | 418/55.3 |
| 3,874,827 | 4/1975 | Young | 418/57 |
| 4,300,875 | 11/1981 | Fischer et al. | 418/55.3 |

FOREIGN PATENT DOCUMENTS

| | | | |
|---|---|---|---|
| 55-40220 | 3/1980 | Japan | 418/57 |
| 59-115487 | 7/1984 | Japan | 418/55.3 |
| 62-3101 | 1/1987 | Japan | 418/55.3 |

*Primary Examiner*—John J. Vrablik

[57] ABSTRACT

Co-orbiting scroll members are maintained in a fixed angular relationship. Each of the scroll members coacts with anti-rotation structure. The scroll members orbit in orbits of different radii.

7 Claims, 2 Drawing Sheets

COUPLING MECHANISM FOR CO-ORBITING SCROLL MEMBERS

BACKGROUND OF THE INVENTION

In a scroll machine such as a pump, compressor or expander there is one basic coaction between the scroll elements in that one must orbit with respect to the other. The scroll element orbiting with respect to the other scroll element is generally called the orbiting scroll. In known designs both scroll elements are rotating, both are orbiting, or one is fixed or only capable of axial movement. A design where both scroll elements orbit, but at different radii, is exemplified by U.S. Pat. No. 3,874,827 which discloses a number of embodiments. Basically, however, the disclosed embodiments have a driven orbiting scroll which has a fixed orbit and which, in turn, drives a driven scroll which is able to move in a minor/smaller orbit as well as axially. The driven scroll is acted on by discharge pressure which forces the driven scroll into axial engagement with the driving scroll. The driven scroll is also acted on by a resilient material member which tends to locate the driven scroll at a position corresponding to the center of the minor orbit. The driven scroll moves in an orbiting motion subject to the bias of the resilient material which may make the orbit non-circular. In the disclosed embodiments, the compressor is of the open drive type with the motor above the scrolls and, in most embodiments, an anti-rotation device is in the discharge chamber of the scrolls.

SUMMARY OF THE INVENTION

The present invention is directed to a scroll machine having two orbiting scrolls. A minor scroll coacts with fixed pins carried by a seal plate and the inner surface of a pilot ring which guides and supports the minor scroll in its movement through its minor orbit to thereby provide radial compliance. Intermediate pressure acts on the minor scroll to provide an axial compliance force to maintain the minor and major/orbiting scrolls in engagement. The major/orbiting scroll rides on the crankcase. The crankcase, pilot ring and seal plate are bolted together and hold the major and minor scrolls as well as the anti-rotation structure therebetween.

It is an object of this invention to couple two components in a fixed angular relationship while allowing one component, the minor scroll, to orbit about pins defining anti-rotation structure.

It is another object of this invention to provide a co-orbiting scroll machine which maintains a fixed angular relationship between the two orbiting members. These objects, and others as will become apparent hereinafter, are accomplished by the present invention.

Basically, a scroll machine is provided with co-orbiting scroll members which are maintained in a fixed angular relationship. Each of the scroll members coacts with anti-rotation structure and is located within an assembly defined by a seal plate, pilot ring and crankcase which are secured together.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
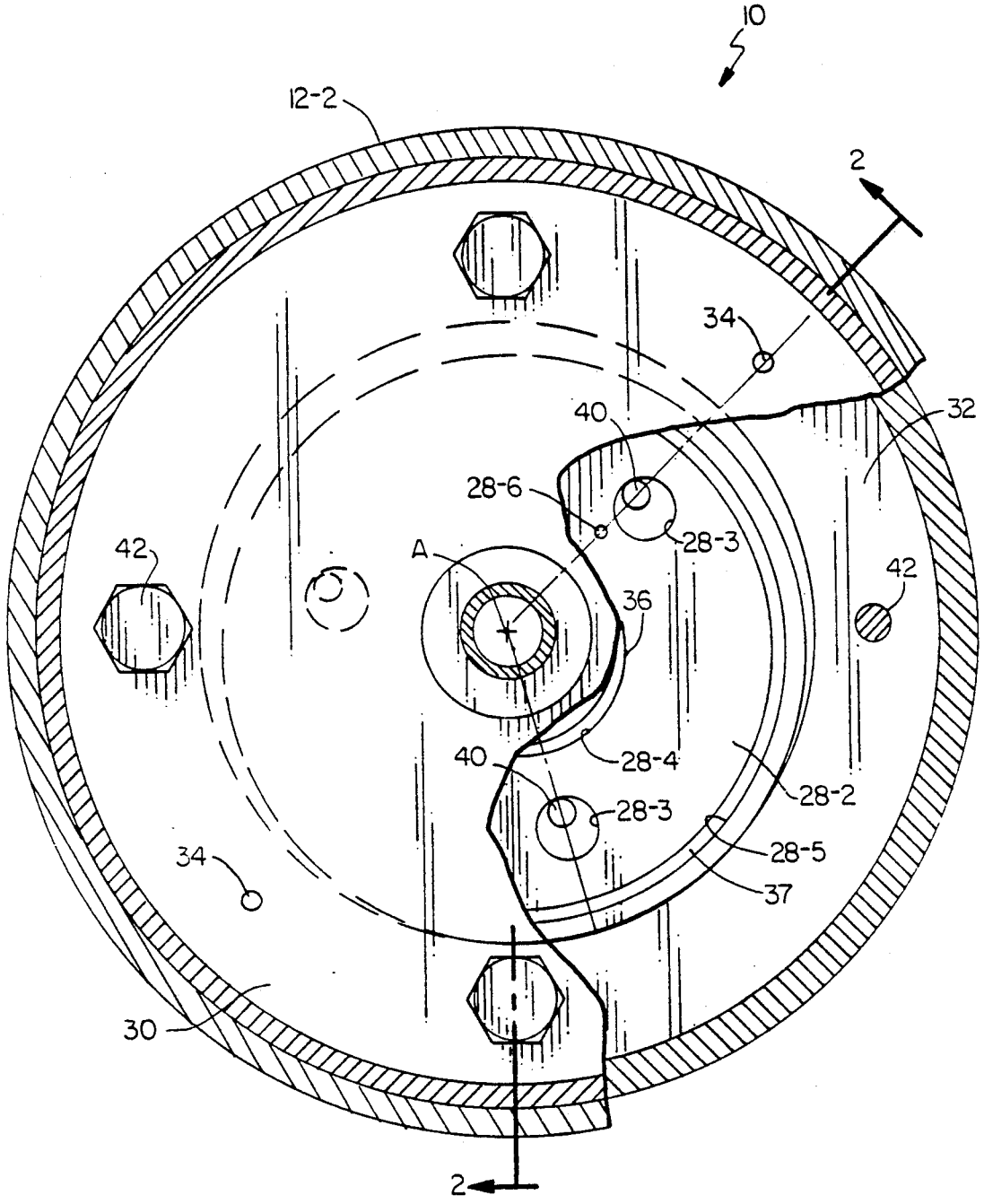
FIG. 1 is a partially cutaway horizontal section taken along line 1—1 of FIG. 2.
Figure 2:
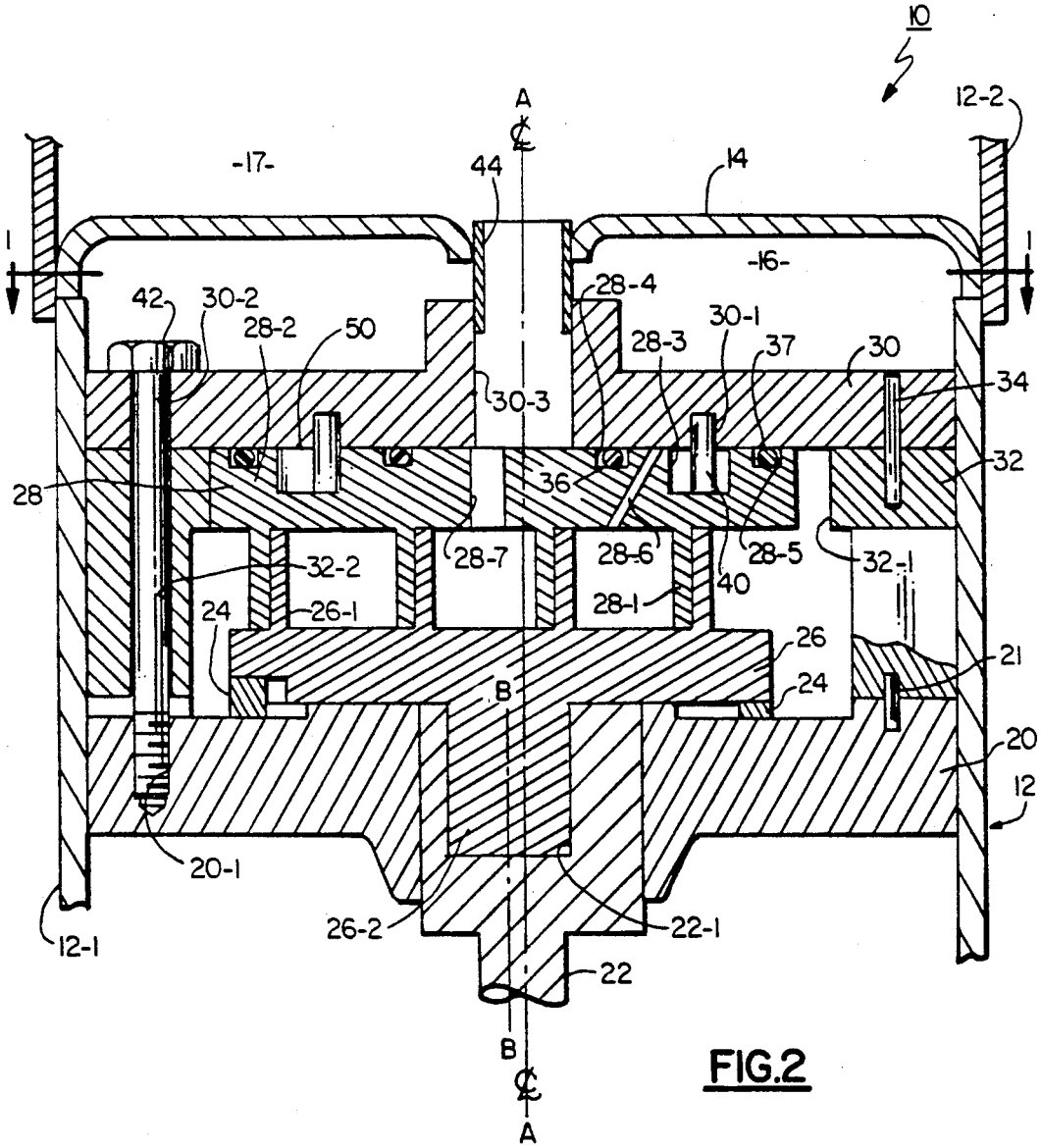
FIG. 2 is a vertical section taken along a line corresponding to 2-2 of FIG. 1.

In the Figures, the numeral 10 generally designates a low side hermetic scroll compressor. Compressor 10 has a shell or casing 12 having a main body 12-1 with an upper cover 12-2. Separator plate 14 divides the shell 12 into a suction plenum 16 and a discharge plenum 17. A crankcase 20 is welded or otherwise suitably secured within main body 12-1 and supports crankshaft 22 and Oldham coupling 24 in a conventional manner. Crankshaft 22 receives hub 26-2 of major or driving scroll 26 in eccentrically located recess 22-1. Major or driving scroll 26 is supported by crankcase 20 and coacts with Oldham coupling 24 in a conventional manner. Crankshaft 22 drives major or driving scroll 26 at a fixed radius. Major or driving scroll 26 has a wrap 26-1 which coacts with wrap 28-1 of minor or driven scroll 28.

Major scroll 26, minor scroll 28 and Oldham coupling 24 are held in place between crankcase 20 and seal plate 30. Specifically, pilot ring 32 surrounds scrolls 26 and 28 and is accurately secured to seal plate 30 by precision dowels 34 so that seal plate 30 and pilot ring 32 are, effectively, an integral structure. Similarly, pilot ring 32 is accurately secured to crankcase 20 by precision dowels 21. If desired, pilot ring 32 and seal plate 30 can be parts of the same member thereby eliminating the need for dowels 34 and their associated bores. Minor scroll 28 has a base 28-2 having a plurality of circular recesses 28-3 formed therein.

Preferably, there are three recesses 28-3 spaced 120° apart. Inner and outer annular recesses 28-4 and 28-5, respectively, are formed in the surface of base 28-2 and receive O-rings or other suitable seals 36 and 37, respectively. One or more restricted fluid passages 28-6 extend through base 28-2 from a point located between seals 36 and 37 and a point located between adjacent turns of wrap 28-1. A plurality of axially extending pins 40 corresponding in number and spacing to the centers of recesses 28-3 are located in bores 30-1 of seal plate 30.

In assembling compressor 10, with scroll 26 in place, wrap 28-1 of scroll 28 is placed in engagement with wrap 26-1 of scroll 26. Seals 36 and 37 are put in place. At this time or prior to setting scroll 28 in place, pilot ring 32 is accurately located with respect to crankcase 20 by precision dowels 21. The seal plate 30 is set in place such that pins 40 are received in corresponding recesses 28-3 and is doweled to pilot ring 32 such that bores defined by bores 30-2, 32-2 and 20-1 are aligned to form a continuous bore and bolts 42 are threaded into the continuous bores. Discharge tube 44 is located and sealed in bore 30-3 and separator plate 14 is secured to discharge tube 44 and main body 12-1. Cover 12-2 is then sealed in place. When so assembled, major scroll 26 is capable of orbital movement in a circle having a radius equal to the distance between A—A the axis crankshaft 22 and B—B the axis of hub 26-2. Scroll 28 is capable of orbital movement through a circle having a diameter equal to the difference in diameters of recess 28-3 and pin 40 and a diameter equal to the difference in diameter between the base 28-2 and the corresponding portion of pilot ring 32 defined by annular surface 32-1.

In operation, a motor (not illustrated) drives crankshaft 22 causing it to rotate about its axis A—A carrying eccentrically located hub 26-2 of major scroll 26. Because major scroll 26 coacts with Oldham coupling 24, major scroll 26 is held to an orbiting motion when driven by crankshaft 22 with the radius of the orbit being equal to the distance between axes A—A and B—B. Wrap 26-1 of major scroll 26 coacts with wrap 28-1 of minor scroll 28 to trap volumes of gas from suction plenum 16 and compress the gas with the resultant compressed gas passing serially through discharge port 28-7, bore 30-3 and discharge tube 44 into discharge plenum 17 from which the compressed gas passes to the refrigeration system via an outlet (not illustrated). As the gas is being compressed the resultant pressure results in a force acting on scrolls 26 and 28 tending to separate them axially and radially. Radial movement of minor scroll 28 is limited by base 28-2 coacting with the inner annular surface 32-1 of pilot ring 32. Additionally, pins 40 limit movement of minor scroll 28 to an orbiting motion. Axial separation of scrolls 26 and 28 is limited by seal plate 30 which is bolted to pilot ring 32 and crankcase 20 by bolts 42. Axial separation of scrolls 26 and 28 is opposed by fluid pressure in annular chamber 50. Annular chamber 50 is located between seal plate 30 and minor scroll 28 with its inner boundary defined by seal 36 and its outer boundary defined by seal 37. Chamber 50 is in fluid communication with a location at an intermediate pressure in the compression process via one or more fluid passages 28-6. As a result, the pressure in chamber 50 axially forces minor scroll 28 into axial engagement with major scroll 26.

To summarize the operation, major scroll 26 is driven in a fixed orbiting motion. Responsive to the fluid pressure of the compression process, base 28-2 of the minor scroll is forced into engagement with surface 32-1 of pilot ring 32 and maintains engagement while being held to a minor orbiting motion by pins 40. Minor scroll 28 is held in axial engagement with major scroll 26 by fluid pressure in chamber 50.

Although a preferred embodiment of the present invention has been illustrated and described, other changes will occur to those skilled in the art. For example, seal plate 30 and pilot ring 32 can be portions of a single member thereby eliminating the need for dowels 34. Also, although the terms major and minor scrolls have been used, their orbits can be the same or the "minor" orbit may be larger than the "major" orbit. Further, chambers 50 can be located in seal plate 30 and pins 40 carried by scroll 28. It is therefore intended that the scope of the present invention is to be limited only by the scope of the appended claims.

What is claimed is:

1. A fluid machine comprising:

a first scroll member having a wrap;

means for limiting said first scroll member to orbiting motion in an orbit having a first diameter;

a second scroll member having a wrap and a base and being operatively engaged with said first scroll member;

radial motion limiting means surrounding said base and coacting therewith to limit radial movement of said base and thereby said second scroll member to a predetermined distance;

means for limiting said second scroll member to orbiting motion in an orbit having a second diameter which is equal to said predetermined distance;

axial compliance means for maintaining said first and second scroll members in engagement, whereby said radial motion limiting means, said means for limiting said second scroll member to orbiting motion and said axial compliance means coact to maintain said second scroll member in axial and radial engagement with said first scroll member.

2. The fluid machine of claim 1 wherein said axial compliance means includes means overlying said base and defining therewith a fluid pressure chamber and fluid path means connecting said fluid pressure chamber to a pressurized trapped volume defined between said wraps of said first and second scroll members.

3. The fluid machine of claim 2 wherein said means for limiting said second scroll member to orbiting motion is located within said fluid pressure chamber.

4. A low side hermetic scroll compressor means comprising:

shell means;

crankcase means fixedly located in said shell means;

first scroll means having a wrap and supported by said crankcase means;

first anti-rotation means coacting with said first scroll means to limit movement of said first scroll means to an orbiting motion having a first radius;

second scroll means having a wrap and a circular base and operatively engaged with said first scroll means;

pilot ring means surrounding said first and second scroll means and having a circular opening which receives said circular base with a radial clearance;

seal plate means overlying said second scroll means;

second anti-rotation means coacting with said second scroll means;

means securing said seal plate means, said pilot ring means and said crankcase means together as a unit containing said first and second scroll means and said first and second anti-rotation means;

said circular opening of said pilot ring means coacting with said circular base and said second anti-rotation means to limit motion of said second scroll means to an orbital motion having a second radius which corresponds to said radial clearance, whereby when said first scroll means is driven it, in turn, drives said second scroll means with said first and second scroll means moving in orbiting motions of said first and second radii, respectively.

5. The scroll compressor means of claim 4 further comprising axial compliance means including a fluid pressure chamber defined by said seal plate means and said second scroll means and fluid path means connecting said fluid pressure chamber to a pressurized trapped volume defined between said wraps of said first and second scroll means.

6. The scroll compressor means of claim 4 wherein said second anti-rotation means is located within said fluid pressure chamber.

7. The scroll compressor means of claim 4 wherein said second anti-rotation means includes a plurality of pins carried by said seal plate and received in corresponding recesses in said base with said pins and said recesses having a difference in diameters which is equal to twice said second radius.

* * * * *